US006951067B1

(12) United States Patent
Dietz et al.

(10) Patent No.: US 6,951,067 B1
(45) Date of Patent: Oct. 4, 2005

(54) METHOD AND APPARATUS FOR CONTROLLING POSITIONING OF AN IMPLEMENT OF A WORK MACHINE

(75) Inventors: Hans P. Dietz, Naperville, IL (US); Thomas G. Skinner, Aurora, IL (US)

(73) Assignee: Caterpillar, Inc., Peoria, IL (US)

( * ) Notice: Subject to any disclaimer, the term of this patent is extended or adjusted under 35 U.S.C. 154(b) by 1105 days.

(21) Appl. No.: 09/885,254

(22) Filed: Aug. 31, 2000

(51) Int. Cl.[7] ..... G05D 1/02; G05D 1/04; E02F 5/02

(52) U.S. Cl. ..... 37/348; 37/348; 37/414; 37/382; 701/50; 91/361

(58) Field of Search ..... 37/348, 382, 907, 37/414; 172/1–6, 10; 414/699, 700; 701/50; 91/361

(56) References Cited

U.S. PATENT DOCUMENTS 4,625,622 A * 12/1986 Gunda et al. ..... 91/36
4,844,685 A * 7/1989 Sagaser ..... 414/700
5,062,264 A 11/1991 Frenette et al.
5,182,908 A 2/1993 Devoer et al.
5,189,940 A * 3/1993 Hosseini et al. ..... 91/361
5,333,533 A * 8/1994 Hosseini ..... 91/361
5,511,458 A * 4/1996 Kamata et al. ..... 91/361
5,537,818 A * 7/1996 Hosseini et al. ..... 60/327
5,617,723 A 4/1997 Hosseini et al.
5,701,793 A * 12/1997 Gardner et al. ..... 91/361
5,875,701 A 3/1999 Cobo et al.
5,899,008 A 5/1999 Cobo et al.
6,032,093 A 2/2000 Denbraber et al.
6,047,228 A * 4/2000 Stone et al. ..... 701/50
6,185,493 B1 2/2001 Skinner et al.
6,233,511 B1 * 5/2001 Berger et al. ..... 701/50
6,253,136 B1 * 6/2001 Stratton et al. ..... 701/50
6,257,118 B1 7/2001 Wilbur et al.
6,385,519 B2 * 5/2002 Rocke ..... 701/50
6,459,976 B1 * 10/2002 Chen et al. ..... 701/50
6,498,973 B2 * 12/2002 Dix et al. ..... 701/50
6,785,596 B2 * 8/2004 Rossow et al. ..... 701/50

* cited by examiner

*Primary Examiner*—Thomas B. Will
*Assistant Examiner*—Thomas A Beach

(57) ABSTRACT

An apparatus for controllably positioning a work implement of an earth moving machine is disclosed. The work implement includes a boom and an attachment being attached thereto where the boom is actuated by a hydraulic lift cylinder and the attachment is actuated by a hydraulic tilt cylinder. Implement position sensors sense the elevational position of the boom and the pivotal position of the attachment and responsively produce respective implement position signals. A controller that receives the implement position signals, compares the relative position of the boom and the attachment with a pre-determined boundary condition, and produces an electrical valve signal. A valve assembly receives the electrical valve signal and controllably provides hydraulic fluid flow to the respective hydraulic cylinders in response to a magnitude of the electrical valve signal.

10 Claims, 4 Drawing Sheets

METHOD AND APPARATUS FOR CONTROLLING POSITIONING OF AN IMPLEMENT OF A WORK MACHINE

This application was originally filed as a U.S. provisional patent application on Aug. 31, 2000, and assigned Ser. No. 60/229,483. The U.S. provisional patent application was then converted on May 29, 2001, to a U.S. non-provisional patent application by petition.

TECHNICAL FIELD

This invention relates generally to a method and apparatus for controlling positioning of a work implement of a work machine and, more particularly, to an apparatus and method that controls the positioning of the work implement based on pre-determined boundary conditions.

BACKGROUND ART

Work machines such as wheel type loaders include work implements capable of being moved through a number of positions during a work cycle. Such implements typically include attachments such as buckets, forks, and other material handling apparatus which are coupled to lift arm, or boom, movably connected to the work machine via lingages. The typical work cycle associated with a bucket includes sequentially positioning the bucket and boom in a digging position for filling the bucket with material, a carrying position, a raised position, and a dumping position for removing material from the bucket. To protect the boom against the implement or linkages being "slammed" into it, the boom is provided with a plurality of rack and dump stops placed on the respective upper and lower surfaces of the boom. Each rack and dump stop is typically strategically sized and arranged to engage a corresponding portion of either the attachment, the attachment linkages, or both, thereby concentrating any attachment impact to selected areas of the boom. In addition, rack and/or dump stops are typically attached, by use of mechanical fasteners, to the attachment.

Control levers are mounted at the operator's station and are connected to an electrohydraulic circuit for moving the bucket and/or boom. The operator must manually move the control levers to open and close electrohydraulic valves that direct pressurized fluid to hydraulic cylinders which in turn cause the implement to move. For example, when the boom is to be raised, the operator moves the control lever associated with the boom hydraulic circuit to a position at which a hydraulic valve causes pressurized fluid to flow to the head end of a lift cylinder, thus causing the boom to rise. When the control lever returns to a neutral position, the hydraulic valve closes and pressurized fluid no longer flows to the lift cylinder.

Under certain operating conditions, the attachment or linkage may make contact with the boom. For example, when the attachment is placed in the dump cycle, the attachment may contact the under portion of the boom as the operator attempts to either dislodge material from, or load material into, the attachment. Likewise, contact between the attachment or linkage and the top portion of the boom may occur when the operator attempts to "catch" or cause material to be caught by the attachment. If not properly inspected and maintained, missing or damaged rack and dump stops can lead to excessive forces placed on the boom. These forces may damage the boom, as well as damage the associated hydraulic circuitry that absorb some of the shock that travels through the linkage assembly. This will likely increase maintenance and accelerated failure of the associated parts.

To reduce the forces acting upon the work implement, systems have been developed to more slowly and smoothly stop the motion of the implement. One such system is disclosed in U.S. Pat. No. 5,617,723 issued to Hosseini et al. on Apr. 8, 1997. A method is provided which uses joystick and implement position sensors for controlling a sudden change in inertia of a work implement of a work machine. While this system adequately reduces the velocity of the work implement during sudden changes in operator control settings, it is not operable to control the movement of a work implement in response to missing rack or dump stops.

An alternate system is disclosed in U.S. Pat. No. 5,511,458, issued to Kamata et al. on Apr. 30, 1996. This system utilizes cylinder position and movement direction detectors to provide a quiet cylinder cushioning effect. Although this system may also be adequate for its intended purpose, it also is not operable to control the movement of a work implement in response to missing rack or dump stops.

The present invention is directed to overcoming one or more of the problems as set forth above.

DISCLOSURE OF THE INVENTION

In one aspect of the present invention, an apparatus for controllably positioning a work implement is disclosed. The work implement includes a boom and an attachment being attached thereto where the boom is actuated by a hydraulic lift cylinder and the attachment is actuated by a hydraulic tilt cylinder. Implement position sensors sense the elevational position of the boom and the pivotal position of the attachment, and responsively produce respective implement position signals. A controller receives the implement position signals, compares the relative position of the boom and the attachment, and produces a valve signal. A valve assembly receives the valve signal and controllably provides hydraulic fluid flow to at least one hydraulic cylinder in response to a magnitude of the electrical valve signal.

In another aspect of the present invention, a method for controllably positioning a work implement of an earth moving machine is provided. The work implement includes a boom and an attachment being attached thereto where the boom is actuated by a hydraulic lift cylinder and the attachment is actuated by a hydraulic tilt cylinder. The method comprises the steps of sensing the positions of the lift and tilt cylinders and producing respective implement position signals, receiving the implement position signals and producing a valve signal based on a relative position of the boom and the attachment, comparing the relative positions of the boom and the attachment with a pre-determined boundary position, and receiving the valve signal and controllably providing hydraulic fluid flow to at least one hydraulic cylinder in response to the relative positions of the boom and attachment in comparison with the predetermined boundary position.

BEST MODE FOR CARRYING OUT THE INVENTION

Figure 1:
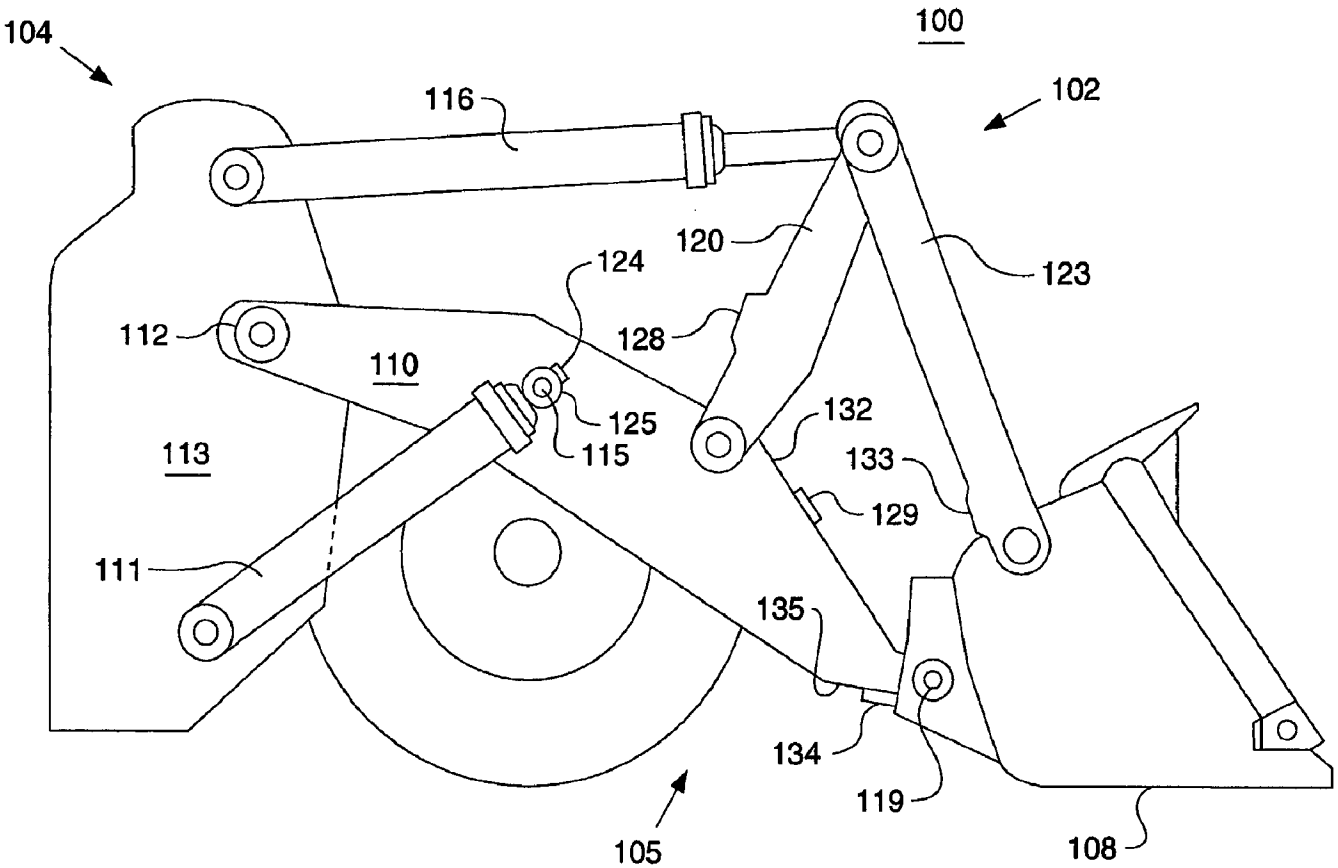
FIG. 1 is a side view of a forward portion of a loader machine or wheel type loader.

FIG. 1 shows a forward portion 100 of a wheel loader type work machine 104 having a work implement 105 attached therewith consisting of a payload carrier in the form of a bucket 108 attached to boom 110. Although the present invention is described in relation to a wheel type loader machine, the present invention is equally applicable to many earth working machines such as track type loaders, hydraulic excavators, and other machines having similar loading implements. The bucket 108 is connected to a lift arm assembly or boom 110 which is pivotally actuated by two hydraulic lift actuators or lift cylinders 111 (only one of which is shown) about a boom pivot pin 112 that is attached to the machine frame 113. Pivot pin 115, in turn, attaches the lift cylinders 111 to the boom 110. In addition, the bucket 108 is tilted by a bucket tilt actuator or cylinder 116 about a tilt pivot pin 119.

The bucket 108 is kinematically connected with the tilt cylinder 116 by means of a pair of boom links 120 and a pair of implement links 123 (one of each shown). Rack stops 124 are provided on each boom boss 125 and are sized and arranged to engage corresponding engagement structures 128 provided on each boom link 120. In addition, a second pair of rack stops 129 (one shown) are provided on the upper surface 132 of the boom 110 are sized and arranged to engage corresponding engagement structures 133 provided on each implement link 123. A pair of dump stops 134 (one shown) are provided on the under portion 135 of the boom 110 and are sized and arranged to engage corresponding engagement structures (not shown) provided on the bucket 108.

Figure 2:
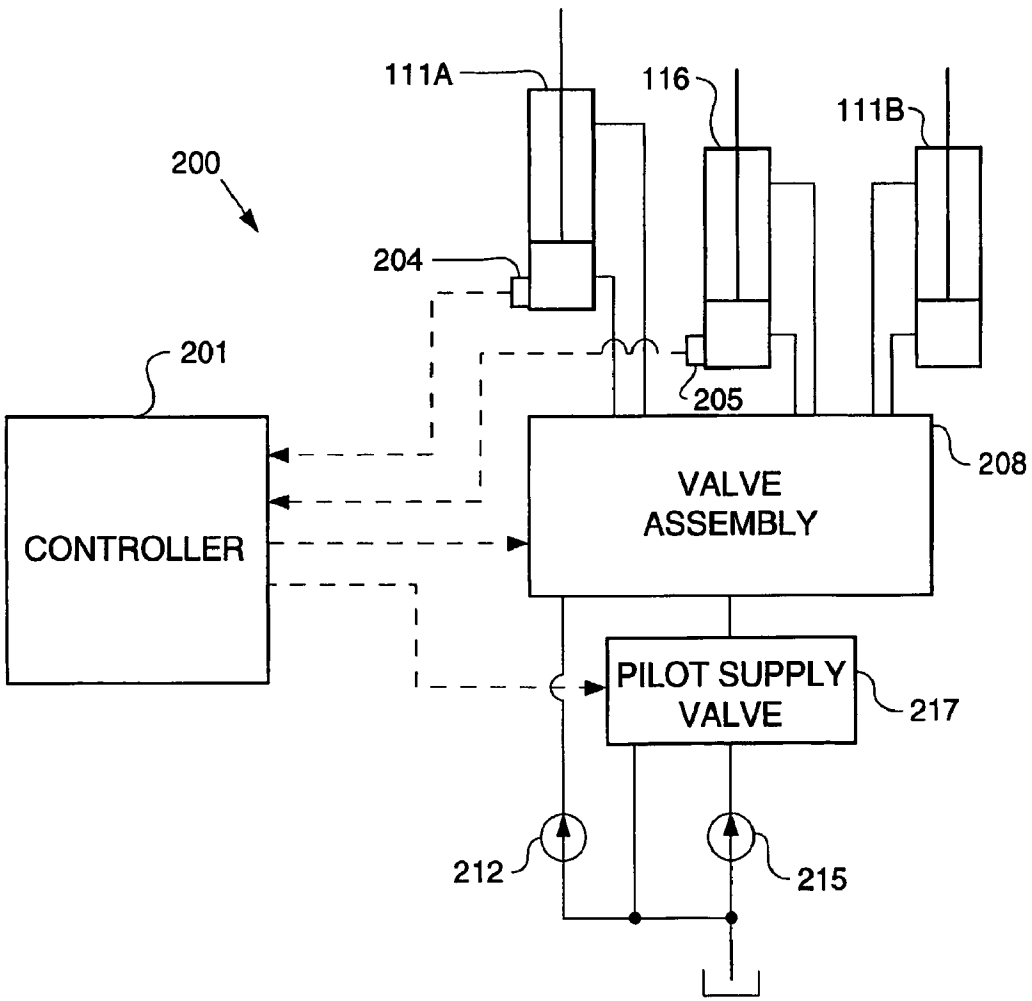
FIG. 2 is a diagrammatic illustration of an embodiment of the implement control system of the present invention.

With reference to FIG. 2, a preferred embodiment of the implement control system 200 as applied to a wheel type loader is diagrammatically illustrated. The implement control system 200 is adapted to sense a plurality of inputs and responsively produce output signals which are delivered to various actuators in the implement control system 200. Preferably, the implement control system includes a microprocessor based controller 201.

Implement position sensors 204, 205 sense the position of the work implement 105 with respect to the work machine 104 and responsively produces a plurality of implement position signals. The implement position signals are a function of the position of the respective hydraulic cylinders 116, 111, and are indicative of the amount of the respective hydraulic cylinder extension. In the preferred embodiment, the position sensors 204, 205 include a lift position sensor 204 for sensing the elevational position of the boom 110 and a tilt position sensor 205 for sensing the pivotal position of the bucket 108.

In one embodiment, the lift and tilt position sensor 204, 205 include rotary potentiometers. The rotary potentiometers produce pulse width modulated signals in response to the angular position of the boom 110 with respect to the vehicle and the bucket 108 with respect to the boom 110. The angular position of the boom is a function of the lift cylinder extension 111A, B, while the angular position of the bucket 108 is a function of both the tilt and lift cylinder extensions 116, 111A, B. The function of the position sensors 204, 205 can readily be any other sensor which are capable of measuring, either directly or indirectly, the relative extension of a hydraulic cylinder. For example, the rotary potentiometers could be replaced with magnetostrictive sensors or linear position potentiometers used to measure the extension of the hydraulic cylinders.

A valve assembly 208 is responsive to electrical signals produced by the controller 201 and provides hydraulic fluid flow to the hydraulic cylinders 111A, B, 116. In the preferred embodiment, the valve assembly 208 includes two main valves (one main valve for lift cylinders and one main valve for the tilt cylinder) and four hydraulic actuator valves (two for each main valve). The main valves direct pressured fluid to the cylinders 111A, B, 116 and the hydraulic actuator valves direct pilot fluid flow to the main valves. Each hydraulic actuator valve preferably comprises a electro-hydraulic valve which is electrically connected to the controller 201. Such valves are well-known and could readily be selected by one of ordinary skill in such art without undue experimentation. One main pumps 212 is used to supply hydraulic fluid to the main spools, while a pilot pump 215 is used to supply hydraulic fluid to the hydraulic actuator valves. An on/off solenoid valve and pressure relief valve 217 are included to control pilot fluid flow to the hydraulic actuator valves.

The present invention is directed toward determining an electrical valve signal magnitude which will accurately prevent impact between the bucket 108 or linkages 120, 123 and the boom 110 in the event of the bucket 108, boom 110, and/or linkages 120, 123 having a missing or damaged rack or dump stop. The controller 201 preferably includes RAM and ROM modules that store software programs to carry out certain features of the present invention. Further, the RAM and ROM modules store software a plurality of look-up tables that are used to determine the electrical valve signal magnitude corresponding to the relative orientation or proximity of the bucket 108 to the boom 110 (based on tilt and lift cylinder extension). The controller 201 receives the implement position signals and produces an electrical valve signal having a magnitude corresponding to aforementioned extensions of the cylinders 111, 116.

The valve assembly 208 receives the electrical valve signal and, depending upon where the proximity of the boom 110 is to the bucket 108, may modify the existing hydraulic fluid flow to the respective hydraulic cylinder in response to a magnitude of the electrical valve signal. For example, the aforementioned look-up tables may include scaling factors associated with each extension measurement of both cylinders 111, 116. The scaling factor may have a value ranging from 0 to 100%. Depending on the scaling value provided in the aforementioned look-up table, if the orientation or proximity of the boom 110 to the bucket 108 is such that the bucket 108 should have encountered a rack or dump stop, the controller 201 will produce an electrical valve signal having a scaling value of 0%, thereby operatively reducing flow in the relevant hydraulic valve, relative to the operator input setting for this hydraulic flow, sufficient to cease movement of, for example, the bucket 108. Conversely, a scaling value of 100% signifies a "safe" condition allowing for uninterrupted full operator control of the relevant hydraulic valve. Scaling factors between 0% and 100% signify a "caution" condition in which operator selected hydraulic fluid flow to the relevant hydraulic valve is proportionately reduced so as to preferably reduce motion of the bucket 108. Although all embodiments described herein are directed toward reducing or ceasing motion of the bucket 108, it is envisioned that the present invention may be directed toward ceasing or reducing the motion of the bucket 108, the boom 110, or both.

As should be apparent to those of ordinary skill in the art, the aforementioned scale factors are customized to correspond to the actual physical boundary represented by the missing rack or dump stops 124, 129, 134. As should be apparent by those of ordinary skill in such art, the scaling factors represent a pre-determined boundary condition which either reduces, shuts off, or allows for uninterrupted flow to the relevant cylinder or cylinders 111, 116. In so doing, potential damage to the bucket 108, the boom 110, or both can be avoided.

Figure 3:
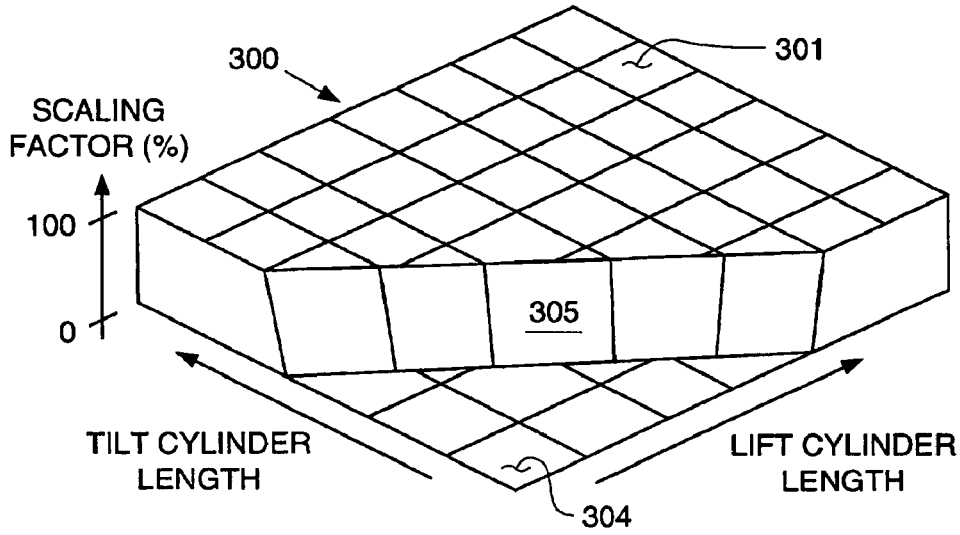
FIG. 3 is a software look-up table associated with rack gain.
Figure 4:
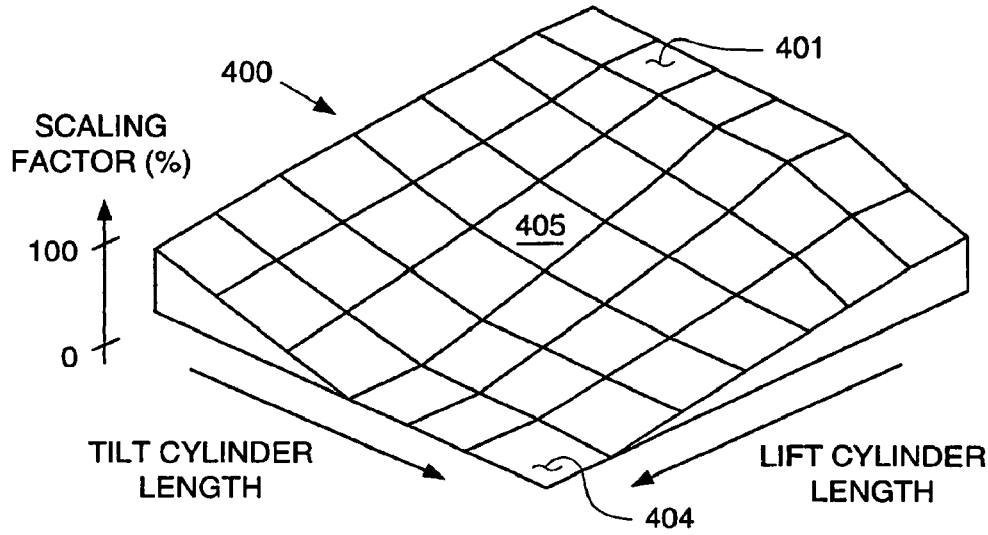
FIG. 4 is a software table look-up table associated with dump gain.

FIGS. 3 and 4 show, respectively, one embodiment each of look-up tables comprising a rack gain table 300 and a dump gain table 400. The rack and dump gain tables 300, 400 represent three-dimensional look-up tables that stores a plurality of scaling values that correspond to the position of the lift and the tilt cylinders 111, 116 as the bucket 108 is being, respectively, racked back in a carrying mode and rotated in a dumping mode. With reference to both Figures, the aforementioned "safe" condition is represented by the areas 301, 401 and corresponds to a scaling factor of 100% (uninterrupted hydraulic fluid flow). Areas designated as 304, 404 represent the aforementioned "danger" condition which triggers a scaling factor of 0% (stopped movement of, for example, the bucket 108). Those areas designated as 305, 405 represent the aforementioned "caution" condition in which the operator selected fluid flow is reduced in proportion to the magnitude of the scaling factor (between 0–100%). Although a scaling value is described, a limiting value can equally be used as would be apparent to one skilled in the art.

Figure 5:
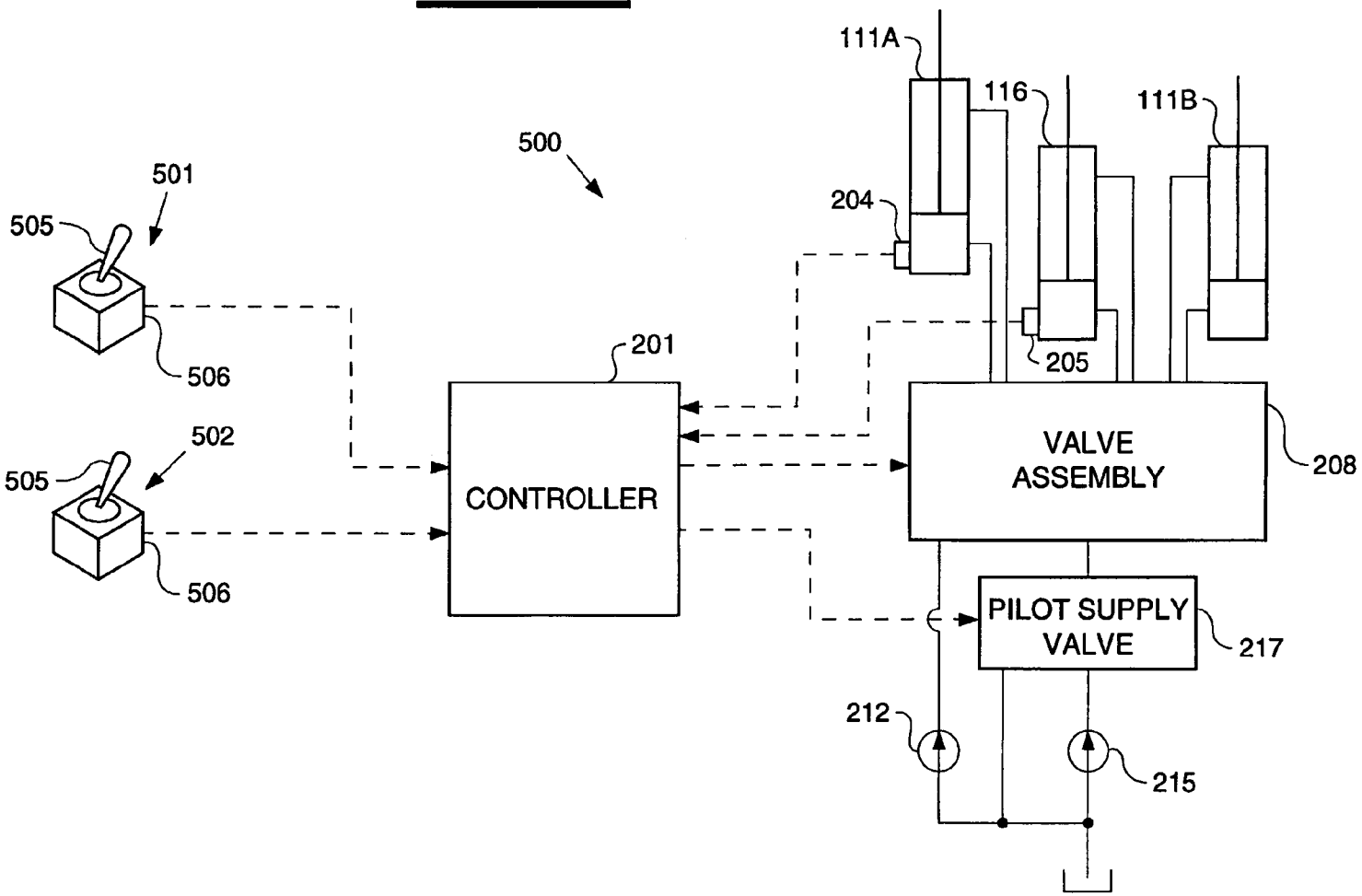
FIG. 5 is a diagrammatic illustration of another embodiment of the implement control system of the present invention.

With reference to FIG. 5, another embodiment 500 of the present invention will now be described. As shown, first and second joysticks 501, 502 provide operator control over the work implement 105. The joysticks 501, 502 include a control lever 505 that has movement along a single axis. However, in addition to movement along a first axis (horizontal), the control lever 505 may also move along a second axis which is perpendicular to the horizontal axis. The first joystick 501 controls the lifting operation of the boom 110. The second joystick 502 controls the tilting operation of the bucket 108.

A joystick position sensor 506 senses the position of the joystick control lever 505 and responsively generates an electrical operator command signal. The electrical signal is delivered to an input of the controller 201. The joystick position sensor 506 preferably includes a rotary potentiometer which produces a pulse width modulated signal in response to the pivotal position of the control lever; however, any sensor that is capable of producing an electrical signal in response to the pivotal position of the control lever would be operable with the instant invention.

The controller 201 receives the implement position signals and operator command signals, modifies the operator command signal by multiplying the aforementioned scaling factor by the magnitude of the operator command signal, and produces an electrical valve signal having a magnitude that is responsive to the modified operator command signal. The valve assembly 208 receives the electrical valve signal, and controllably provides hydraulic fluid flow to the respective hydraulic cylinder in response to a magnitude of the electrical valve signal. The magnitude of the electrical valve signal, in turn, is determined by multiplying the aforementioned scaling factor by the magnitude of the operator command signal.

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

Earth working machines such as wheel type loaders and excavators include work implements capable of being moved through a number of positions during a work cycle. The typical work cycle includes positioning the boom and bucket in a digging position for filling the bucket with material, a dumping position where the boom is raised and the bucket is tilted forward for removing material from the bucket, and a carrying position where the boom is being lowered and the bucket is tilted back in a racked position.

The present invention provides a method and apparatus for automatically limiting the velocity of the bucket 108 as the bucket 108 approaches an orientation with respect to the boom 110 in which the bucket 108 or linkages 120, 123 should had encountered a physical boundary associated with a missing rack or dump stop 124, 128, 129, 133, 134. Upon encountering the aforementioned boundary, the bucket 108 is directed to stop moving, thereby preventing potential damage which may be caused by the bucket 108 "slamming" into the boom 110.

It should be understood that while the function of the preferred embodiment is described in connection with the boom and associated hydraulic circuits, the present invention is readily adaptable to control the position of implements for other types of earth working machines. For example, the present invention could be employed to control implements on hydraulic excavators, backhoes, and similar machines having hydraulically operated implements.

Other aspects, objects and advantages of the present invention can be obtained from a study of the drawings, the disclosure and the appended claims.

What is claimed is:

1. A method of rotating an implement relative to a work machine, the work machine comprising an implement rotatable in at least first and second opposing directions, a mechanical stop mounted to the work machine which contacts the implement when the implement has rotated in the first direction to a first angular position, a hydraulic fluid cylinder mounted between the implement and the work machine for rotating the implement, and a valve for supplying hydraulic fluid to the hydraulic fluid cylinder, the method comprising:

receiving an operator input commanding rotation of the implement;

producing a valve signal responsive to the operator input;

receiving the valve signal and opening the valve responsive thereto to supply hydraulic fluid to the hydraulic fluid cylinder;

rotating the implement in the first direction under the force of the hydraulic fluid to an angular position beyond the first angular position; and overriding an operator input commanding continued rotation of the implement in the first direction by producing a valve signal to close the valve and stop the rotation of the implement.

2. A method according to claim 1 wherein the work machine further comprises a boom rotatably attached to a frame, the mechanical stop being mounted to the boom, the implement being rotatably attached to the boom, a first sensor for measuring the position of the boom relative to the frame, a second sensor for measuring the position of the implement relative to the frame, the method further comprising:

receiving the position of the boom relative to the frame from the first sensor;

receiving the position of the implement relative to the frame from the second sensor; and detecting that the implement has rotated to an angular position beyond the first angular position by analyzing the position of the boom relative to the frame and the position of the implement relative to the frame.

3. A method according to claim 1 wherein the method further comprises:

using the position of the boom relative to the frame and the position of the implement relative to the frame and a look up table to determine a scaling value;

modifying the operator input command in response to the scaling value; and wherein the scaling value is approximately zero for combinations of boom positions and implement positions that correspond to the implement being rotated to an angular position beyond the first angular position.

4. A work machine comprising:

a frame;

a first member rotatable relative to the frame;

a second member rotatable relative to the first member;

a first hydraulic cylinder operable to extend and retract and extending between the frame and the second member to power the rotation of the second member relative to the first member;

an electronic control module (ECM) which receives an operator input command for rotation of the second member, the electronic control module producing a valve signal in response to the operator input command;

a valve which receives the valve signal and is in fluid communication with the first hydraulic cylinder, the valve providing hydraulic fluid to power extension and retraction of the first hydraulic cylinder;

a mechanical stop located on the first member, the second member contacting the mechanical stop at a first angular position when the second member rotates in a first direction;

wherein the ECM permits operator input to move the second member in the first direction to the first angular position and beyond by producing a valve signal to rotate the second member in the first direction; and wherein the ECM overrides operator input to move the second member in the first direction by producing a valve signal to stop continued rotation of the second member in the first direction after the second member has moved to a second angular position beyond the first angular position in the first direction.

5. A work machine according to claim 4 wherein when the second member is moving in the first direction and is approaching the first angular position, the ECM modifies the operator input by producing a valve signal to rotate the second member at a rate slower than that called for by the operator input command.

6. A work machine according to claim 5, the work machine further comprising:

a second hydraulic cylinder extending between the frame and the first member;

a first sensor for sensing the extension length of the first hydraulic cylinder;

a second sensor for sensing the extension length of the second hydraulic cylinder; and wherein the ECM receives a first sensor signal from the first sensor and a second sensor signal from the second sensor.

7. A work machine according to claim 6 wherein:

the ECM uses the first sensor signal and the second sensor signal and a look up table to determine a scaling value, with a discreet scaling value associated in the look up table with each possible combination of first sensor signal values and second sensor signal values; and the ECM modifies the operator input through the scaling value to produce a valve signal.

8. A work machine according to claim 4, the work machine further comprising:

a second hydraulic cylinder extending between the frame and the first member;

a first sensor for sensing the extension length of the first hydraulic cylinder;

a second sensor for sensing the extension length of the second hydraulic cylinder; and wherein the ECM receives a first sensor signal from the first sensor and a second sensor signal from the second sensor.

9. A work machine according to claim 8 wherein:

the ECM uses the first sensor signal and the second sensor signal and a look up table to determine a scaling value, with a discreet scaling value associated in the look up table with each possible combination of first sensor signal values and second sensor signal values; and the ECM overrides the operator input through an approximately zero scaling value to produce the valve signal to stop continued rotation of the second member.

10. A method of rotating a bucket relative to a boom of a work machine, the bucket rotatable in at least first and second opposing directions, a mechanical stop mounted to boom which contacts the bucket when the bucket has rotated in the first direction to a first angular position, a hydraulic fluid cylinder operatively attached to the bucket for rotating the bucket relative to the boom, and a valve for supplying hydraulic fluid to the hydraulic fluid cylinder, the method comprising:

receiving an operator input commanding rotation of the bucket relative to the boom;

producing a valve signal responsive to the operator input;

receiving the valve signal at the valve and the valve opening responsive thereto to supply hydraulic fluid to the hydraulic fluid cylinder;

rotating the bucket in the first direction under the force of the hydraulic fluid to a second angular position beyond the first angular position; and overriding an operator input commanding continued rotation of the bucket in the first direction by producing a valve signal to close the valve and stop the rotation of the bucket.

* * * * *